US011410627B2

(12) United States Patent
Xiao et al.

(10) Patent No.: US 11,410,627 B2
(45) Date of Patent: Aug. 9, 2022

(54) DUAL GATE ARRAY SUBSTRATE AND DISPLAY DEVICE

(71) Applicants: Beijing BOE Display Technology Co., Ltd., Beijing (CN); BOE TECHNOLOGY GROUP CO., LTD., Beijing (CN)

(72) Inventors: Wenjun Xiao, Beijing (CN); Shijun Wang, Beijing (CN); Wenkai Mu, Beijing (CN); Bingqing Yang, Beijing (CN); Yi Liu, Beijing (CN); Bo Feng, Beijing (CN); Xiaoxiao Chen, Beijing (CN); Yang Wang, Beijing (CN); Zhiying Bao, Beijing (CN); Haoliang Ji, Beijing (CN); Tianxin Zhao, Beijing (CN); Ji Dong, Beijing (CN); Hao Xu, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 67 days.

(21) Appl. No.: 16/835,558

(22) Filed: Mar. 31, 2020

(65) Prior Publication Data

US 2021/0056924 A1 Feb. 25, 2021

(30) Foreign Application Priority Data

Aug. 19, 2019 (CN) ..... 201910762139.2

(51) Int. Cl.
*G09G 3/36* (2006.01)

(52) U.S. Cl.
CPC ..... *G09G 3/3688* (2013.01); *G09G 3/3696* (2013.01)

(58) Field of Classification Search
CPC ..... G09G 3/3688; G09G 3/3696; G09G 2330/021; G09G 2300/0426;
(Continued)

(56) References Cited

U.S. PATENT DOCUMENTS

2012/0249492 A1* 10/2012 Kim ..... G09G 3/3648 345/204
2016/0260370 A1* 9/2016 Gu ..... G02F 1/1345
(Continued)

FOREIGN PATENT DOCUMENTS

CN 207380420 U 5/2018
CN 109427250 A 3/2019
KR 20060028969 A * 4/2006

OTHER PUBLICATIONS

Lee et al.,, Machine Translation of Foreign Patent Document KR 20060028969 A, Thin Film Transistor Array Panel and Repairing Method Thereof, Apr. 4, 2016, pp. 1-18 (Year: 2006).*
(Continued)

*Primary Examiner* — Amr A Awad
*Assistant Examiner* — Maheen I Javed
(74) *Attorney, Agent, or Firm* — Xsensus LLP

(57) ABSTRACT

The embodiment of the present disclosure provides a dual gate array substrate and a display device. The dual gate array substrate includes pairs of gate lines and data lines. The pairs of gate lines and the data lines intersect perpendicularly to define multiple display units arranged in an array. The display units include two sub-pixels of a same color, and the sub-pixels of the same color on both sides of one data line are coupled to the one data line.

16 Claims, 6 Drawing Sheets

(58) Field of Classification Search
CPC .. G09G 3/3614; G09G 3/2074; G09G 3/2003; G02F 1/136286; G02F 1/1362; G02F 1/136222; H01L 27/1214; H01L 27/124
See application file for complete search history.

(56) References Cited

U.S. PATENT DOCUMENTS

| | | | | |
|---|---|---|---|---|
| 2017/0178578 | A1* | 6/2017 | Du | G09G 3/3614 |
| 2020/0118476 | A1* | 4/2020 | Kim | G09G 3/2074 |

OTHER PUBLICATIONS

Second Office Action for CN Patent Application No. 201910762139.2 dated Sep. 5, 2021.

* cited by examiner

--Prior Art--

--Prior Art--

DUAL GATE ARRAY SUBSTRATE AND DISPLAY DEVICE

CROSS-REFERENCE TO RELATED APPLICATION

This application is based upon and claims priority to Chinese Patent Application No. 201910762139.2, filed on Aug. 19, 2019, the entire contents thereof are incorporated herein by reference.

TECHNICAL FIELD

The present disclosure relates to the field of display technology and, in particular, to a dual gate array substrate and a display device.

BACKGROUND

Liquid crystal display devices (LCD) are widely used in modern information apparatuses, such as displays, televisions, mobile phones, and digital products, due to various advantages, such as light weight, low power consumption, low radiation, and easy portability. A main structure of the liquid crystal display device comprises an array substrate, a color filter substrate, and a liquid crystal layer filled therebetween.

With the development of high-resolution displays, not only power consumption of display devices, but also cost of driving integrated circuits (ICs) gradually increase. In order to reduce the cost of driving ICs, an array substrate with a dual gate driving has been proposed in the related art. The dual gate driving can not only reduce the number of data lines, thereby reducing the cost of driving the ICs, but also reduce a space of fan-out wirings, thereby reducing a width of frame.

In actual application, it has been found, however, that a dual gate driving display device has the problem of large power consumption. Therefore, how to reduce the power consumption of the dual gate driving display device is a technical problem to be solved in the art.

SUMMARY

The present disclosure provides a dual gate array substrate and a display device.

An embodiment of the present disclosure provides a dual gate array substrate including a plurality of pairs of gate lines and a plurality of data lines, wherein the plurality of pairs of gate lines and the plurality of data lines intersect perpendicularly to define a plurality of display units arranged in an array. The display unit includes two sub-pixels of a same color, and the sub-pixels of the same color on both sides of one data line are coupled to the one data line.

Optionally, each row of the display units includes the display units of three colors arranged periodically, and each column of the display units includes the display units of two colors arranged alternately.

Optionally, each pair of gate lines includes a first gate line and a second gate line, and a row of the display units defined by the first gate line and the second gate line is arranged between the first gate line and the second gate line.

Optionally, the two sub-pixels of the display unit include a first sub-pixel and a second sub-pixel arranged along a row direction of the display units, and in the row of the display units, the first sub-pixels of all the display units are coupled to one of the first gate line and the second gate line, and the second sub-pixels of all the display units are coupled to the other one of the first gate line and the second gate line.

Optionally, in an odd row of the display units, the second sub-pixels of all the display units are coupled to the first gate line, and the first sub-pixels of all the display units are coupled to the second gate line; and in an even row of the display units, the first sub-pixels of all the display units are coupled to the first gate line, and the second sub-pixels of all the display units are coupled to the second gate line.

Optionally, in the row of the display units, the first sub-pixels and the second sub-pixels of all the display units are coupled to the data lines at same sides of all the display units.

Optionally, in an odd row of the display units, the first sub-pixels and the second sub-pixels of all the display units are coupled to the date lines at left sides of all the display units; and in an even row of the display units, the first sub-pixels and the second sub-pixels of all the display units are coupled to the data lines at right sides of all the display units.

Optionally, the dual gate array substrate further includes a common electrode line parallel to the data line and disposed between the two sub-pixels.

Optionally, polarities of data voltages transmitted through adjacent data lines are opposite to each other.

An embodiment of the present disclosure provides a display device including the dual gate array substrate described above.

Of course, it is not necessary for any product or method of the present disclosure to achieve all the advantages described above at the same time. Other features and advantages of the present disclosure will be explained in the following description of embodiments, and will become apparent from the description of embodiments, or be understood by implementing the present disclosure. The objects and other advantages of embodiments of the present disclosure can be achieved and obtained by structures specifically set forth in the description, claims, and drawings.

BRIEF DESCRIPTION OF THE DRAWINGS

The drawings are used to provide further understanding of the technical solutions of the present disclosure, and constitute a part of the specification. The drawings are used to explain the technical solutions of the present disclosure along with embodiments of the present disclosure, and are not intended to limit the technical solutions of the present disclosure. The shapes and sizes of components in the drawings do not reflect the true scale, and are only intended to illustrate the present disclosure.

DETAILED DESCRIPTION

Specific implementations of the present disclosure are described in further details below with reference to the accompanying drawings and embodiments. The following embodiments are used to illustrate the present disclosure, but not to limit the scope of the present disclosure. It should be noted that the embodiments in the present disclosure and the features in the embodiments can be arbitrarily combined with each other if there is no conflict.

Figure 1:
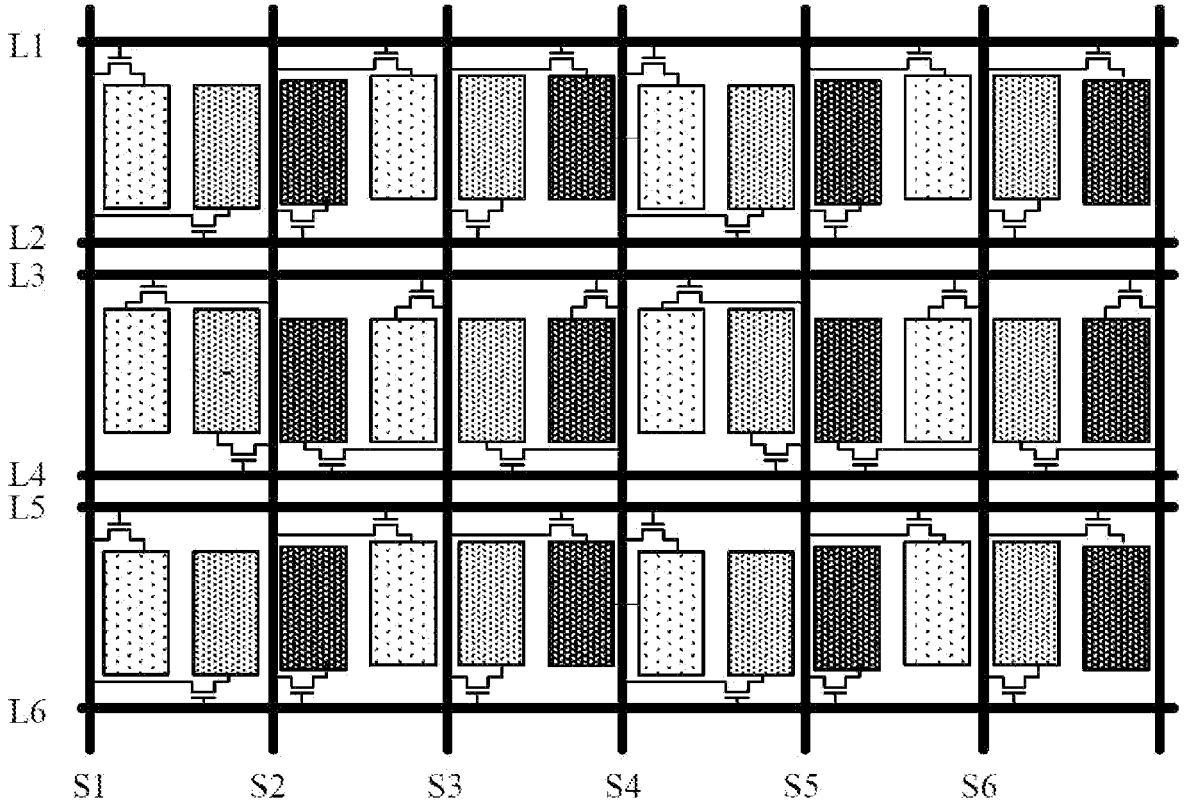
FIG. 1 is a schematic structural diagram of a conventional dual gate array substrate.
Figure 2:
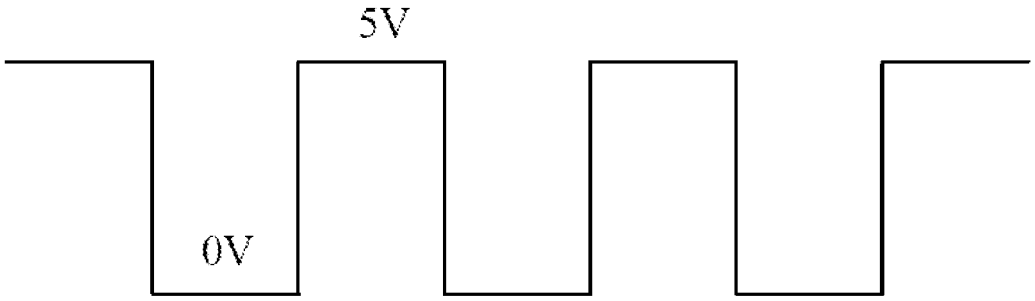
FIG. 2 is a schematic diagram of an output of a data line when a conventional dual gate array substrate displays a single color frame.

The inventors found that a conventional dual gate driving display device has a problem of large power consumption. One main reason of which is that the conventional dual gate driving display device consumes large power when displaying a single color frame. FIG. 1 is a schematic structural diagram of the conventional dual gate array substrate. As shown in FIG. 1, the conventional dual gate array substrate includes a plurality of sub-pixels arranged in an array. A red (R) sub-pixel, a green (G) sub-pixel, and a blue (B) sub-pixel are arranged periodically in each pixel row, and the respective sub-pixels in each pixel column are of the same color. Since the sub-pixels in two adjacent columns are of different colors, and one data line of the dual gate array substrate is coupled to the sub-pixels in the two adjacent columns, the colors of the sub-pixels coupled to a same data line are different. By taking a data line S2 shown in FIG. 1 as an example, in a first pixel row, the data line S2 is coupled to the blue sub-pixel and the red sub-pixel on the right side of the data line S2. In a second pixel row, the data line S2 is coupled to the green sub-pixel and the red sub-pixel on the left side of the data line S2. In a third pixel row, the data line S2 is also coupled to the blue sub-pixel and the red sub-pixel on the right side of the data line S2. In this way, when a single color frame is displayed, an output voltage of the data line S2 needs to be constantly changed. By taking that a red frame is displayed as an example, assuming that a data voltage Vp=+5V and a common voltage Vcom=0V, when a first gate line L1 is turned on, the data line S2 needs to output +5V to the red sub-pixel on the right side thereof. When a second gate line L2 is turned on, because the red frame is displayed, the data line S2 needs to output 0V to the blue sub-pixel on the right side thereof. When a third gate line L3 is turned on, the data line S2 needs to output +5V to the red sub-pixel on the left side thereof. When a fourth gate line L4 is turned on, the data line S2 needs to output 0V to the green sub-pixel on the left side thereof. In this way, the output voltage of the data line S2 needs to be changed repeatedly, from +5V to 0V, and from 0V to +5V, which waveform is shown in FIG. 2. Similarly, for other data lines, the output voltages thereof are also changed repeatedly. It can be seen that when the conventional dual gate array substrate displays a single color frame, the output of the data line is actually the same as that of the data line when the frame is reloaded, and the repeated changes of the output voltage cause a large increase in power consumption. The inventors of the present application found through experiments that the power consumption of a single gate driving array substrate when displaying a single color frame is about 120 mW, while the power consumption of a dual gate driving array substrate when displaying a single color frame is 230 mW, which is almost doubled. When the dual gate driving is applied to mobile products, the power consumption is one of the most concerning product parameters to users, and such power consumption is unacceptable to customers.

In order to reduce the power consumption of the dual gate driving display device, an embodiment of the present disclosure provides a dual gate array substrate. A main structure of the dual gate array substrate according to the embodiment of the present disclosure includes a plurality of pairs of gate lines and a plurality of data lines. The plurality of pairs of gate lines and the plurality of data lines intersect perpendicularly to define a plurality of display units arranged in an array, where each of the display units comprises two sub-pixels of a same color and the sub-pixels of the same color on both sides of one data line are coupled to the one data line.

An embodiment of the present disclosure provides a dual gate array substrate in which two sub-pixels of the same color are disposed in each of the display units, and the sub-pixels of the same color on both sides of one data line are coupled to the one data line. Therefore when a single color frame is displayed, a data voltage output by each data line is constant, which significantly reduces power consumption of displaying the single color frame.

The technical solutions of the embodiments of the present disclosure are described in detail below through specific embodiments.

Figure 3:
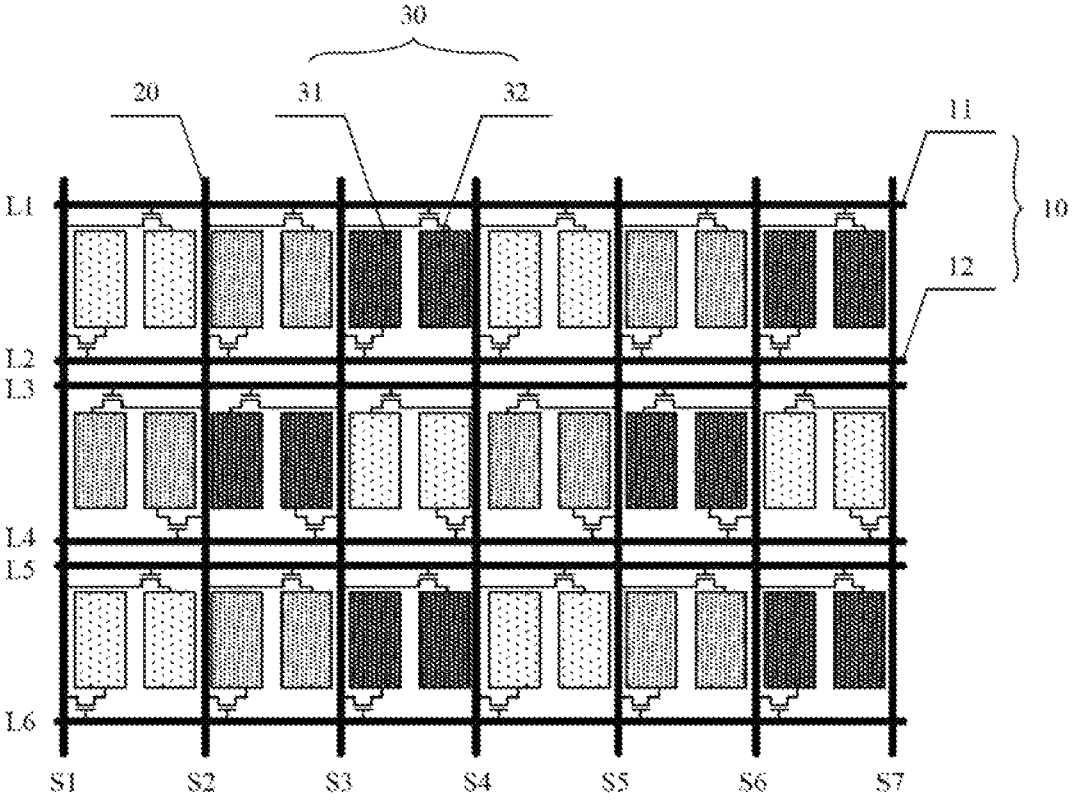
FIG. 3 is a schematic structural diagram of a dual gate array substrate according to an embodiment of the present disclosure.

FIG. 3 is a schematic structural diagram of a dual gate array substrate according to an embodiment of the present invention. As shown in FIG. 3, the dual gate array substrate of this embodiment includes a plurality of pairs of gate lines 10 and a plurality of data lines 20. Each pair of gate lines 10 defines a display unit row, and two adjacent data lines 20 define a display unit column, thereby defining a plurality of display units 30 arranged in an array. The plurality of display units 30 arranged in the array include a display unit of a first color, a display unit of a second color, and a display unit of a third color. In each display unit row, the display unit of the first color, the display unit of the second color, and the display unit of the third color are arranged periodically. In each display unit column, display units of two colors are included and arranged alternately.

Each pair of gate lines 10 includes a first gate line 11 and a second gate line 12 that define the display unit row, and the display unit row is disposed between the first gate line 11 and the second gate line 12. Specifically, assuming that the first color is a red color, the second color is a green color, and the third color is a blue color, as shown in FIG. 3, a first display unit row defined by the gate lines L1 and L2 includes a red display unit, a green display unit, and a blue display unit arranged periodically. A second display unit row defined by the gate lines L3 and L4 includes the green display unit, the blue display unit, and the red display unit arranged periodically. In a third display unit row defined by the gate lines L5 and L6, the arrangement of the display units is the same as that in the first display unit row. In this way, a first display unit column defined by the data lines S1 and S2 includes the red display unit and the green display unit arranged alternately, that is, the red display units are arranged in the first, third, fifth rows, . . . , and the green display units are arranged in the second, fourth, sixth rows, . . . . A second display unit column defined by the data lines S2 and S3 includes the green display unit and the blue display unit arranged alternately, that is, the green display units are arranged in the first, third, fifth rows, . . . , and the blue display units are arranged in the second, fourth, sixth rows, . . . . A third display unit column defined by the data lines S3 and S4 includes the blue display unit and the red display unit arranged alternately, that is, the blue display units are arranged in the first, third, fifth rows, . . . , and the red display units are arranged in the second, fourth, sixth rows, . . . .

Each display unit 30 includes a first sub-pixel 31 and a second sub-pixel 32, which have a same color and are arranged along a display unit row direction. In the display unit row, the first sub-pixels 31 of all the display units 30 are coupled to one gate line, the second sub-pixel 32 of all the display units 30 are coupled to another gate line, and the first sub-pixels 31 and the second sub-pixels 32 of all the display units 30 are coupled to the data lines at the same side of the display units 30. The display units 30, i.e., the first sub-pixels 31 and the second sub-pixels 32, on both sides of one data line 20 are coupled to the one date line 20. The display units 30, i.e., all the first and second sub-pixels 31 and 32, coupled to each data line 20 are of the same color. That is, in each display unit column, all the display units 30 of one color are coupled to one data line 20, and all the display units 30 of another color are coupled to another data line 20.

In an embodiment of the present disclosure, each sub-pixel includes a thin film transistor (TFT) and a pixel electrode, and the pixel electrode is coupled to the thin film transistor. Coupling of the sub-pixel and the gate line may mean that a gate of the thin film transistor in the sub-pixel is coupled to the gate line, coupling of the sub-pixel and the data line may mean that a source of the thin film transistor in the sub-pixel is coupled to the data line, and coupling of the pixel electrode and the thin film transistor may mean that the pixel electrode is coupled to a drain of the thin film transistor, which are well-known coupling structures in the art. According to arrangement changing of the sub-pixel, the coupling of the thin film transistor may be changed in the dual gate array substrate according to an embodiment of the present disclosure. Specifically, in an odd display unit row, the first gate line 11 is coupled to all the second sub-pixels 32, and the second gate line 12 is coupled to all the first sub-pixels 31. In an even display unit row, the first gate line 11 is coupled to all the first sub-pixels 31, and the second gate line 12 is coupled to all the second sub-pixels 32. Meanwhile, in the odd display unit row, all the first sub-pixels 31 and the second sub-pixels 32 are coupled to the data lines 30 at first sides (such as the left sides) thereof. In the even display unit row, all the first sub-pixels 31 and the second sub-pixels 32 are coupled to the data lines 30 at second sides (such as the right sides) thereof. In this way, by changing the arrangement of the sub-pixels and the coupling of the TFT, each data line is only coupled to the sub-pixels of one color.

When the dual gate array substrate of the embodiment of the present disclosure displays a single color frame, each data line outputs a constant data voltage, which can effectively reduce power consumption of displaying the single color frame. The outputs of the respective data lines will be described in detail below by taking that a red frame is displayed as an example.

For the data line S2, when the first gate line L1 is turned on, the data line S2 needs to output a voltage to the second sub-pixel 32 at the right side thereof. Since the second sub-pixel 32 is a green sub-pixel, the data line S2 outputs 0V. When the second gate line L2 is turned on, the data line S2 needs to output a voltage to the first sub-pixel 31 the right side thereof, and since the first sub-pixel 31 is a green sub-pixel, the data line S2 outputs 0V. When the third gate line L3 is turned on, the data line S2 needs to output a voltage to the first sub-pixel 31 on the left side thereof, and since the first sub-pixel 31 is a green sub-pixel, the data line S2 outputs 0V. When the fourth gate line L4 is turned on, the data line S2 needs to output a voltage to the second sub-pixel 32 on the left side thereof, and since the second sub-pixel 32 is a green sub-pixel, the data line S2 outputs 0V. In this way, since all the sub-pixels to which the data line S2 is coupled are the green sub-pixels, the data line S2 outputs 0V continuously.

For the data line S3, since all the sub-pixels to which the data line S3 is coupled are the blue sub-pixels, the data line S3 also outputs 0V continuously.

For the data line S4, when the first gate line L1 is turned on, the data line S4 needs to output a voltage to the second sub-pixel 32 at the right side thereof, and since the second sub-pixel 32 is a red sub-pixel, the data line S4 outputs +5V. When the second gate line L2 is turned on, the data line S4 needs to output a voltage to the first sub-pixel 31 at the right side thereof, and since the first sub-pixel 31 is a red sub-pixel, the data line S4 outputs +5V. When the third gate line L3 is turned on, the data line S4 needs to output a voltage to the first sub-pixel 31 at the left side thereof, and since the first sub-pixel 31 is a red sub-pixel, the data line S4 outputs +5V. When the fourth gate line L4 is turned on, the data line S4 needs to output a voltage to the second sub-pixel 32 at the left side thereof, and since the second sub-pixel 32 is a red sub-pixel, the data line S4 outputs +5V. In this way, since all the sub-pixels to which the data line S4 is coupled are the red sub-pixels, the data line S2 outputs +5V continuously.

Figure 4:
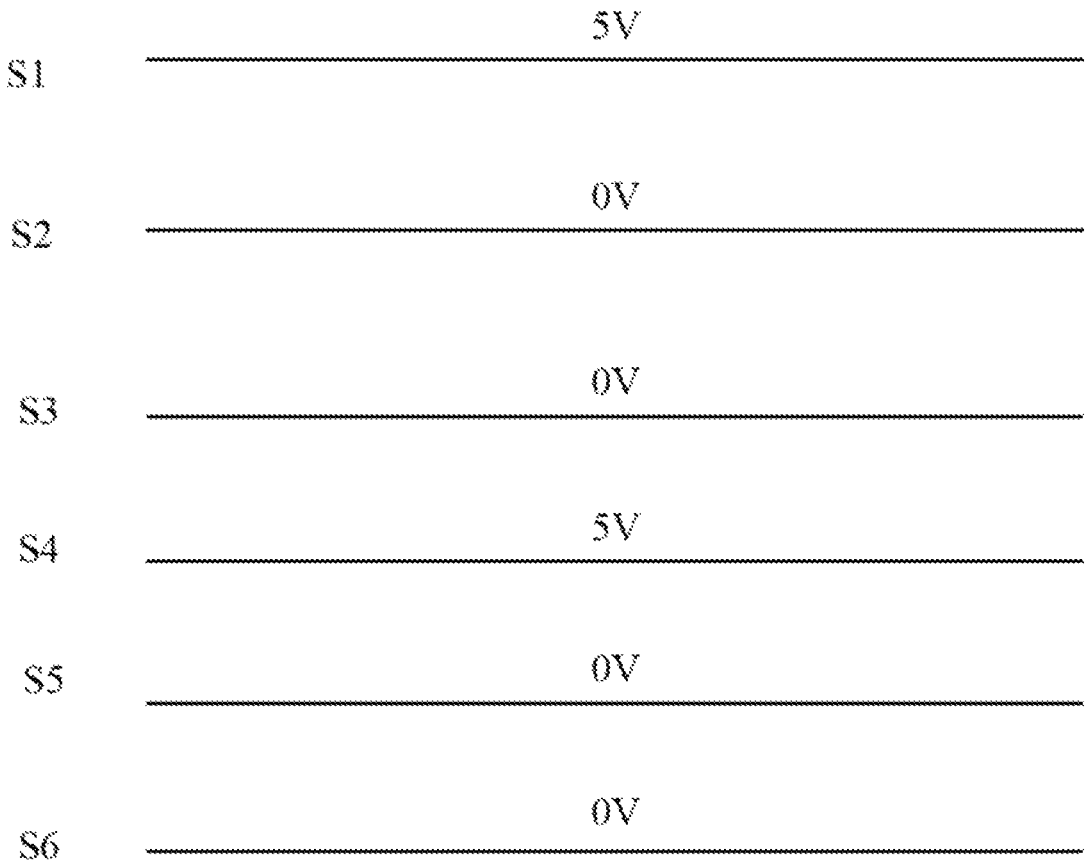
FIG. 4 is a schematic diagram of an output of a data line when the dual gate array substrate shown in FIG. 3 displays a single color frame.

Similarly, for other data lines, the output voltages thereof are also constant, which waveforms are shown in FIG. 4.

As can be seen from the foregoing description, the dual gate array substrate provided by the embodiment of the present disclosure changes arrangement of sub-pixels to periodically arrange RGB by taking the display unit as an unit. Each display unit is provided with two sub-pixels of the same color. In combination with the changing of the TFT coupling, each data line is only coupled to the sub-pixels of one color. Therefore, when a single color frame is displayed, each data line outputs a voltage that is substantially constant, which avoids repeated changes of the output voltage and reduces the power consumption of the data driving circuit, thereby effectively reducing overall power consumption. The inventors of the present disclosure through experiments found that the power consumption of the dual gate array substrate of the embodiment of the present invention when displaying a single frame is about 120 mW, which is equivalent to the power consumption of the conventional single gate driving and is reduced by haft in comparison with that of the conventional dual gate array substrate. Therefore, the power consumption of displaying a single color frame is greatly reduced.

Further, the dual gate array substrate according to the embodiment of the present invention can not only greatly reduce the power consumption of displaying a single color frame, but also can reduce the power consumption of displaying a mixed color frame. Specifically, since in the present disclosure, two sub-pixels of the same color are provided in each display unit, each display unit serves as a single-color unit, and three display units form a color unit, grayscale values of the two sub-pixels in each display unit are the same. In this way, when the first gate line and the second gate line are turned on in sequence, and the data line sequentially outputs data voltages to the two sub-pixels, the two voltage values output by the data line are the same, which avoids extra power consumption caused by repeated changes in output voltage. At the same time, the color of the mixed color frame usually changes continuously, so for the display units coupled to the same data line, the grayscale values of adjacent display units also change continuously. In this way, when the gate lines are turned on row by row and the data lines sequentially output data voltages to the display units of each row, the voltage value output by the data lines is gradually increased or decreased, which also avoids extra power consumption caused by repeated changes in the output voltage. Therefore, the dual gate array substrate according to the embodiment of the present disclosure can also reduce the power consumption for displaying a mixed color screen.

Further, since the dual gate array substrate of the embodiment of the present invention changes the coupling manner of the thin film transistor. In a display unit row, all the first sub-pixels are coupled to one gate line, and all the second sub-pixels are coupled to another gate line. All the first and second sub-pixels are coupled to the data lines at the same sides thereof. Therefore, the couplings of the thin-film transistors are orderly, regular, and clear, which not only simplifies the structure design of the dual-gate array substrate, reduces the difficulty of pixel layout, but also reduces process defects in a preparation process, improves production quality and effectively guarantee the yield. The manufacturing process of the dual gate array substrate of the embodiment of the present invention does not need to change the existing process flow, does not need to change the existing process equipment, does not add new processes, does not introduce new materials, has good process compatibility, has high process realizability, has high practicality, and thus, has good application prospects.

Figure 5:
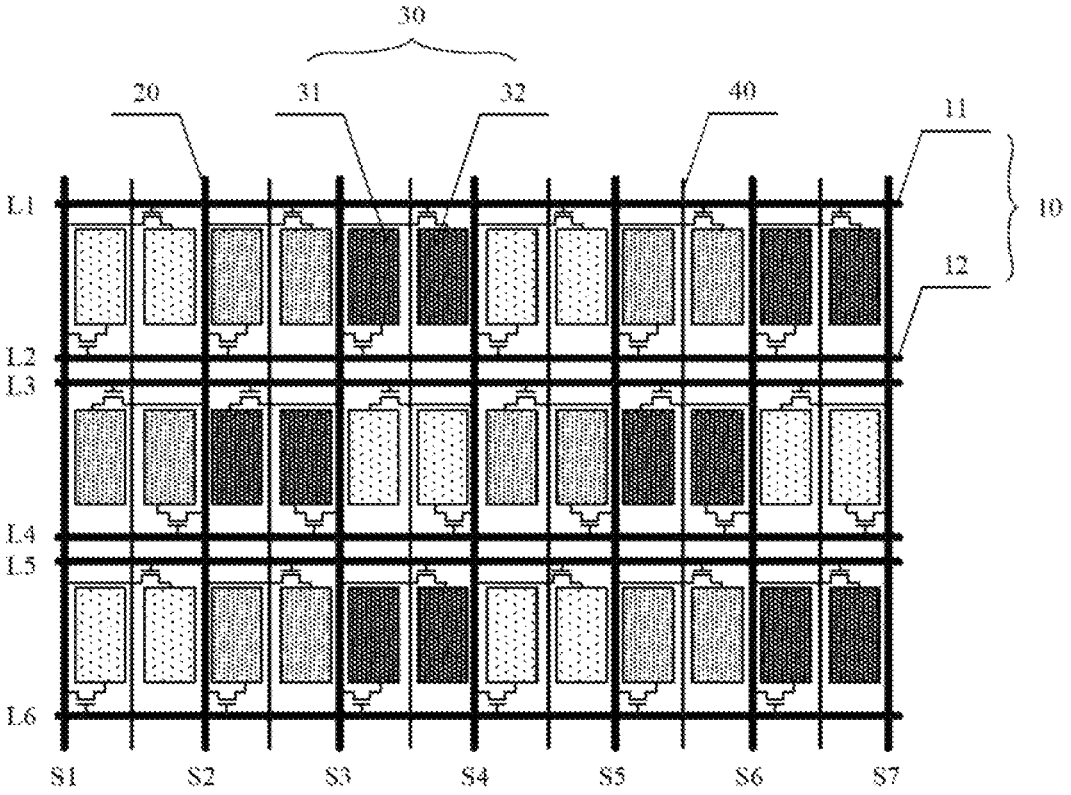
FIG. 5 is a schematic structural diagram of a dual gate array substrate according to another embodiment of the present disclosure.

FIG. 5 is a schematic structural diagram of a dual gate array substrate according to another embodiment of the present disclosure. This embodiment is an extension of the foregoing embodiment. The main structure of the dual gate array substrate is basically the same as the foregoing embodiment, and includes a plurality of pairs of gate lines and a plurality of data lines to define a plurality of display units arranged in an array. Each display unit includes two sub-pixels of a same color, and the sub-pixels of the same color on both sides of one data line are coupled to the one data line. As shown in FIG. 5, the difference is that the dual gate array substrate of this embodiment further includes a common electrode line 40. The common electrode line 40 is parallel to the data line 20 and is disposed between two adjacent data lines 20. Since two adjacent data lines 20 define a display unit column, and each display unit includes two sub-pixels, the common electrode line 40 is disposed between two sub-pixels in each display unit.

This embodiment also achieves the same technical effects as that of the foregoing embodiment, including effectively reducing the power consumption of displaying a single frame, reducing the power consumption of displaying a mixed-color frame to a certain extent, and simplifying the structure of the dual gate array substrate. At the same time, in this embodiment, the common electrode line is arranged between two sub-pixels in each display unit, so the relatively stable voltage of the common electrode line is used to ensure the display uniformity of the two sub-pixels, thereby improving the display quality.

Figure 6:
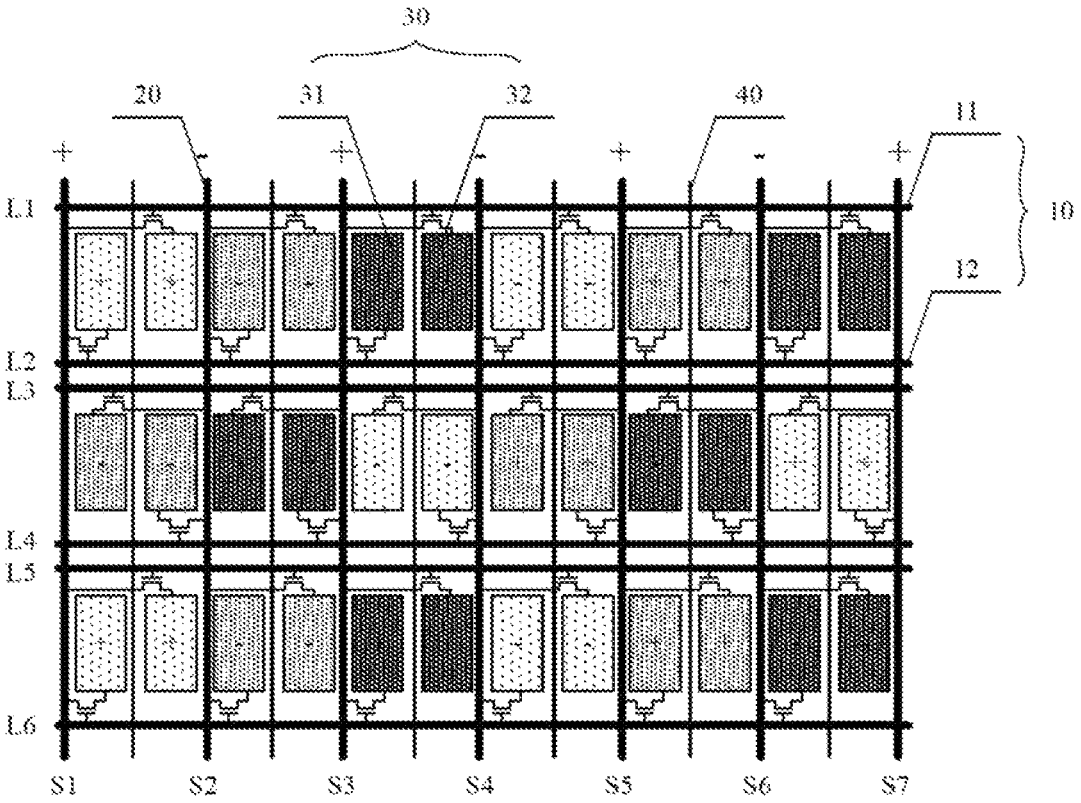
FIG. 6 is a schematic structural diagram of a dual gate array substrate according to still another embodiment of the present disclosure.

FIG. 6 is a schematic structural diagram of a dual gate array substrate according to still another embodiment of the present disclosure. This embodiment is an extension of the embodiment shown in FIG. 5. The main structure of the dual gate array substrate is the same as that of the foregoing embodiment, and includes a plurality of pairs of gate lines and a plurality of data lines to define a plurality of display units arranged in an array. Each display unit includes two sub-pixels of a same color, and the sub-pixels of the same color on both sides of one data line are coupled to the one data line. A common electrode line 40 is disposed between two adjacent data lines 20. As shown in FIG. 6, Polarities of the data voltages transmitted by two adjacent data lines 20 of the dual gate array substrate in this embodiment are opposite to each other. For example, in one frame period, the data voltage transmitted by the data line S1 has a positive polarity, the data voltage transmitted by the data line S2 has a negative polarity, and the data voltage transmitted by the data line S3 has the positive polarity.

Since the display units on both sides of one data line are coupled to the one data line, the adjacent display units have opposite polarities, that is, in a display unit row, the adjacent display units have opposite polarities, and in a display unit column, the adjacent display units have opposite polarities, so that dot inversion is realized in the unit of the display unit, which is beneficial to improving the display image quality.

Since the two sub-pixels in each display unit are coupled to the same data line, the two sub-pixels in each display unit have the same polarity and both sub-pixels operate when the data voltage received by them is positive or operate when the data voltage received by them is negative, which ensures the display uniformity of the two sub-pixels. The inversion method formed in this embodiment can also be referred to as a two-point inversion method. The polarity in the row is inversed according to 2 sub-pixels, and the polarity in the column is inversed according to 1 sub-pixel. In the row, two sub-pixels of positive polarity and two sub-pixels of negative polarity appear alternately, and in the column, one sub-pixel of positive polarity and one sub-pixel of negative polarity appear alternately, which is beneficial to preventing chromatic aberration and reducing the visual defects of the display.

Figure 7:
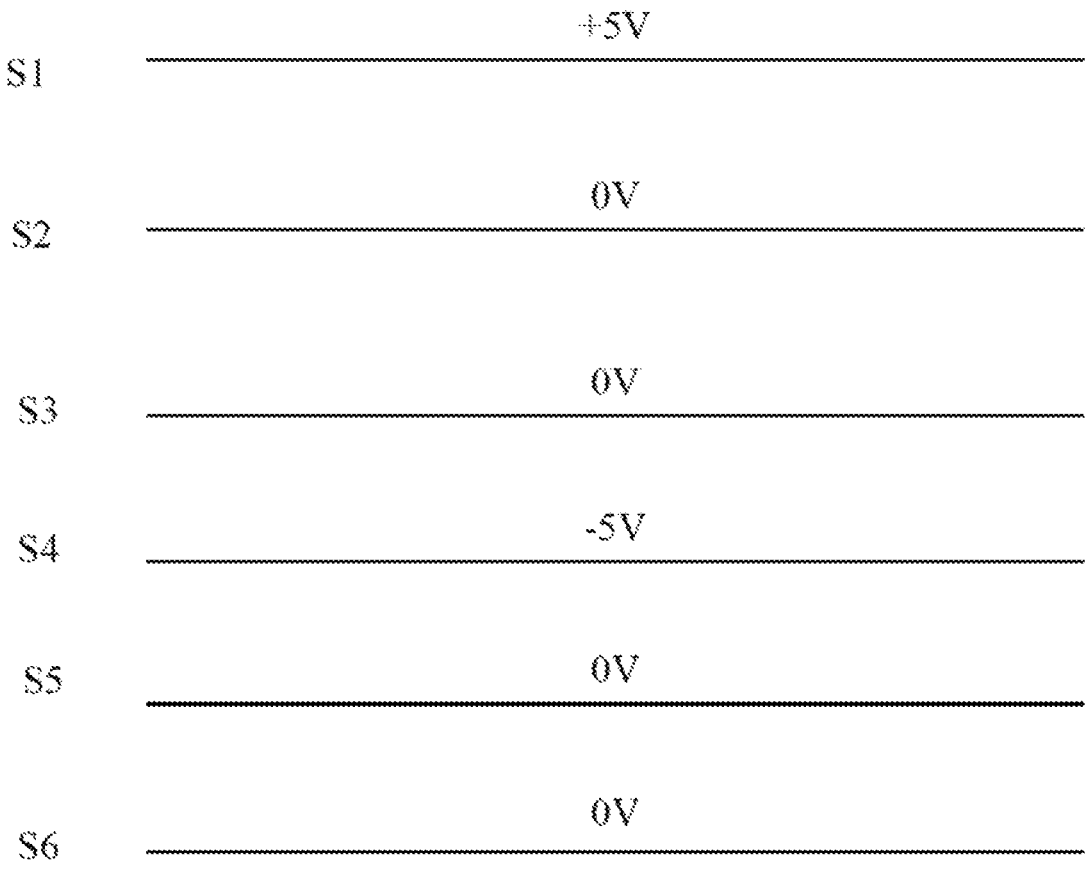
FIG. 7 is a schematic diagram of an output of a data line when the dual gate array substrate shown in FIG. 6 displays a single color frame.

FIG. 7 is a schematic diagram of an output of a data line when a single color frame is displayed (by taking that a red frame is displayed as an example) according to the embodiment of FIG. 6. As shown in FIG. 7, for the data line S1, when the gate lines are turned on in sequence, the voltage is sequentially output to the red sub-pixels on the right and left sides thereof, and because it is positive, +5V is output. In this way, for the positive data line S1, +5V is continuously output. As for the data line S2, when the gate lines are turned on in sequence, the voltage is sequentially output to the green sub-pixels on the right and left sides thereof, and because it is negative, 0V is output. For the data line S3, when the gate lines are turned on in sequence, the voltage is sequentially output to the blue sub-pixels on the right and left sides thereof, and because it is positive, 0V is output. For the data line S4, when the gate lines are turned on in sequence, the voltage is sequentially output to the red sub-pixels on the right and left sides thereof, and because it is negative, −5V is output. In this way, for the negative data line S4, −5V is continuously output.

This embodiment also achieves the technical effects of the foregoing embodiment, including effectively reducing the power consumption of displaying a single color frame, reducing the power consumption of displaying a mixed-color frame to a certain extent, simplifying the structure of the dual gate array substrate, and ensuring the display uniformity of the two sub-pixels. At the same time, this embodiment is beneficial to improving the display image quality by forming a dot inversion by taking the display unit as a unit.

Based on the inventive concept of the foregoing embodiments, an embodiment of the present disclosure further provides a display device. The display device includes the dual gate array substrate of the foregoing embodiments. The display device may be any product or component having a display function, such as a mobile phone, a tablet computer, a television, a display, a notebook computer, a digital photo frame, a navigator, and the like.

In the description of the embodiment of the present disclosure, it should be understood that orientation or position relations indicated by the terms "middle," "upper," "down," "front," "rear," "vertical," "horizontal," "top," "bottom," "inside," and "outside" are based on orientation or position relations shown in the drawings, and are only for the convenience of describing the present disclosure and simplifying the description rather than indicating or implying that the device or element referred to must have a specific orientation, and be constructed and operated in a specific orientation and, therefore, is not to be understood as a limitation on the present disclosure. In addition, the terms "first," "second," and similar terms used herein do not indicate any order, quantity, or importance, but are only used to distinguish different components.

In the description of the embodiment of the present invention, it should be noted that, unless otherwise specified and limited, the terms "install," "connect," and "couple" should be understood in a broad sense. For example, it may be fixed connection or may be detachable connection or integral connection; it may be mechanical or electrical connection; it may be direct connection or indirect connection through an intermediate medium, or it may be internal connection of two components. For those of ordinary skill in the art, the specific meanings of the above terms in the present disclosure can be understood on a case-by-case basis.

Although the embodiments disclosed in the present disclosure are as described above, the content described is only an embodiment adopted for facilitating understanding of the present disclosure, and is not intended to limit the present disclosure. Any person skilled in the art to which the present disclosure pertains may make any modifications and changes in the form and details of implementation without departing from the spirit and scope disclosed by the present disclosure, but the protection scope of the present disclosure must still be subject to the scope defined by the appended claims.

What is claimed is:

1. A dual gate array substrate, comprising:

a plurality of pairs of gate lines and a plurality of data lines, wherein:

the plurality of pairs of gate lines and the plurality of data lines intersect perpendicularly to define a plurality of display units arranged in an array;

each display unit is defined by a pair of gate lines and two adjacent data lines, and each display unit comprises two sub-pixels of a same color;

each pair of gate lines comprises a first gate line and a second gate line, a row of the display units defined by the first gate line and the second gate line being arranged between the first gate line and the second gate line, and each space between two adjacent rows of the display units being provided with a first gate line of a pair of gate lines and a second gate line of another pair of gate lines;

each data line is disposed between two adjacent columns of the display units, connected to a portion of sub-pixels in the two adjacent columns of the display units;

the each data line is coupled to sub-pixels in odd rows of the display units on one side, and is coupled to sub-pixels in even row of the display units on the other side, the sub-pixels coupled to the each data line having a first color; and the sub-pixels not coupled to the each data line, in the two adjacent columns of the display units, have a second color and a third color, the first color, the second color, and the third color being different from one another.

2. The dual gate array substrate according to claim 1, wherein:

each row of the display units comprise the display units of three colors arranged periodically, the three colors comprising the first color, the second color, and the third color; and each column of the display units comprises the display units of two of the three colors arranged alternately.

3. The dual gate array substrate according to claim 1, wherein:

the two sub-pixels of the display unit comprise a first sub-pixel and a second sub-pixel arranged along a row direction of the display units; and in the row of the display units, the first sub-pixels of all the display units are coupled to one of the first gate line and the second gate line, and the second sub-pixels of all the display units are coupled to the other one of the first gate line and the second gate line.

4. The dual gate array substrate according to claim 3, wherein:

in an odd row of the display units, the second sub-pixels of all the display units are coupled to the first gate line type, and the first sub-pixels of all the display units are coupled to the second gate line type; and in an even row of the display units, the first sub-pixels of all the display units are coupled to the first gate line type, and the second sub-pixels of all the display units are coupled to the second gate line type.

5. The dual gate array substrate according to claim 1, wherein in the row of the display units, the first sub-pixels and the second sub-pixels of all the display units are coupled to the data lines at same sides of all the display units.

6. The dual gate array substrate according to claim 5, wherein:

in an odd row of the display units, the first sub-pixels and the second sub-pixels of all the display units are coupled to the date lines at left sides of all the display units; and in an even row of the display units, the first sub-pixels and the second sub-pixels of all the display units are coupled to the data lines at right sides of all the display units.

7. The dual gate array substrate according to claim 1, further comprising a common electrode line parallel to the data line and disposed between the two sub-pixels.

8. The dual gate array substrate according to claim 1, wherein polarities of data voltages transmitted through adjacent data lines are opposite to each other.

9. A display device, comprising:

a dual gate array substrate, wherein the dual gate array substrate comprises a plurality of pairs of gate lines and a plurality of data lines, wherein:

the plurality of pairs of gate lines and the plurality of data lines intersect perpendicularly to define a plurality of display units arranged in an array;

each display unit is defined by a pair of gate lines and two adjacent data lines, and each display unit comprises two sub-pixels of a same color;

each pair of gate lines comprises a first gate line and a second gate line, a row of the display units defined by the first gate line and the second gate line being arranged between the first gate line and the second gate line, and each space between two adjacent rows of the display units being provided with a first gate line of a pair of gate lines and a second gate line of another pair of gate lines;

each data line is disposed between two adjacent columns of the display units, connected to a portion of sub-pixels in the two adjacent columns of the display units;

the each data line is coupled to sub-pixels in odd rows of the display units on one side, and is coupled to sub-pixels in even row of the display units on the other side, the sub-pixels coupled to the each data line having a first color; and the sub-pixels not coupled to the each data line, in the two adjacent columns of the display units, have a second color and a third color, the first color, the second color, and the third color being different from one another.

10. The display device according to claim 9, wherein:

each row of the display units comprises the display units of three colors arranged periodically, the three color comprising the first color, the second color and the third color; and each column of the display units comprises the display units of two colors arranged alternately.

11. The display device according to claim 9, wherein:

the two sub-pixels of the display unit comprise a first sub-pixel and a second sub-pixel arranged along a row direction of the display units, and in the row of the display units, the first sub-pixels of all the display units are coupled to one of the first gate line and the second gate line, and the second sub-pixels of all the display units are coupled to the other one of the first gate line and the second gate line.

12. The display device according to claim 11, wherein:

in an odd row of the display units, the second sub-pixels of all the display units are coupled to the first gate line type, and the first sub-pixels of all the display units are coupled to the second gate line type; and in an even row of the display units, the first sub-pixels of all the display units are coupled to the first gate line type, and the second sub-pixels of all the display units are coupled to the second gate line type.

13. The display device according to claim 9, wherein in the row of the display units, the first sub-pixels and the second sub-pixels of all the display units are coupled to the data lines at same sides of all the display units.

14. The display device according to claim 13, wherein:

in an odd row of the display units, the first sub-pixels and the second sub-pixels of all the display units are coupled to the date lines at left sides of all the display units; and in an even row of the display units, the first sub-pixels and the second sub-pixels of all the display units are coupled to the data lines at right sides of all the display units.

15. The display device according to claim 9, wherein the dual gate array substrate further comprises a common electrode line parallel to the data line and disposed between the two sub-pixels.

16. The display device according to claim 9, wherein polarities of data voltages transmitted through adjacent data lines are opposite to each other.

* * * * *